US008821310B2

(12) United States Patent
Sato

(10) Patent No.: US 8,821,310 B2
(45) Date of Patent: Sep. 2, 2014

(54) GOLF CLUB

(71) Applicant: Bridgestone Sports Co., Ltd., Tokyo (JP)

(72) Inventor: Fumiaki Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 125 days.

(21) Appl. No.: 13/670,926

(22) Filed: Nov. 7, 2012

(65) Prior Publication Data

US 2013/0123039 A1 May 16, 2013

(30) Foreign Application Priority Data

Nov. 15, 2011 (JP) ..... 2011-249750

(51) Int. Cl.
*A63B 53/10* (2006.01)
*A63B 59/00* (2006.01)
*A63B 53/04* (2006.01)

(52) U.S. Cl.
CPC ..... *A63B 53/10* (2013.01); *A63B 2209/023* (2013.01); *A63B 2059/0081* (2013.01); *A63B 2053/0408* (2013.01); *A63B 59/0074* (2013.01)
USPC ..... 473/316; 473/314

(58) Field of Classification Search
USPC ..... 473/316, 314, 318, 289
See application file for complete search history.

(56) References Cited

U.S. PATENT DOCUMENTS

| | | | | |
|---|---|---|---|---|
| 5,947,839 | A | 9/1999 | Kusumoto | |
| 5,971,865 | A * | 10/1999 | Shenoha et al. | 473/316 |
| 6,514,155 | B1 * | 2/2003 | Sheets | 473/314 |
| 7,338,386 | B2 * | 3/2008 | Nakajima | 473/319 |
| 2009/0305809 | A1 * | 12/2009 | Sato | 473/319 |

FOREIGN PATENT DOCUMENTS

| | | | |
|---|---|---|---|
| JP | 06-126005 | A | 5/1994 |
| JP | 09-234256 | A | 9/1997 |
| JP | 10-043333 | A | 2/1998 |
| JP | 11-076481 | A | 3/1999 |
| JP | 2004-160057 | A | 6/2004 |
| JP | 2008-212340 | A | 9/2008 |

* cited by examiner

*Primary Examiner* — Benjamin Layno
(74) *Attorney, Agent, or Firm* — Sughrue Mion, PLLC

(57) ABSTRACT

A golf club includes a shaft and a head, the torque of the entire length of the shaft being in a range of 3 to 5°. From viewpoints of a torsional rigidity distribution of the shaft, an integrated value of the torsional rigidity on the grip end side of the shaft is 85% or less of the integrated value of the torsional rigidity of the entire length of the shaft. The head has a distance to the center of gravity of 40 to 48 mm and a gravity center angle of 22 to 30°.

2 Claims, 5 Drawing Sheets

GOLF CLUB

CROSS-REFERENCE TO RELATED APPLICATION

This application claims priority from Japanese Patent Application No. 2011-249750 filed Nov. 15, 2011, which is incorporated herein by reference in its entirety.

BACKGROUND OF THE INVENTION

The present invention relates to a golf club, more particularly to a golf club in which a shaft designed in a predetermined torsional rigidity and a head designed to have a predetermined center of gravity are combined.

Conventionally, the golf club shafts were designed from viewpoints of a torsional rigidity distribution to meet golfers' head speeds. For example, Japanese Patent Application Publication No. 2008-212340 has disclosed a shaft in which a ratio between the torsional rigidity on the front end side and the torsional rigidity on the grip side is designed within a predetermined range and which enables even a golfer having a relatively slow head speed capacity to hit a ball at a large launch angle and increase the travel distance of the ball.

SUMMARY OF THE INVENTION

For the design of the torsional rigidity distribution of the shaft, conventionally, extensive research and development has been made. Regarding the torsional rigidity of the shaft (usually measured and evaluated as a torque), some of them state the torsional rigidity of an entire shaft length while few of them state a distribution of the torsional rigidity of the shaft. The shaft is in such a cylindrical shape that its diameter decreases toward the front end to the grip side. Therefore, in the distribution of the torsional rigidity of the shaft, usually, the torsional rigidity decreases gradually toward the front end from the grip side of the shaft. When a golfer swings a golf club, a torsion of the shaft occurs mainly on the front end side of the shaft. A professional golfer feels no problem in the shaft having such a torsional rigidity distribution.

As a result of research on the torsional rigidity distribution of the shaft, the inventor of the present invention has found that by changing the torsional rigidity distribution of the shaft compared to a conventional one, a golfer can make an impact timing more easily and that the initial speed of a golf ball is improved. Furthermore, it has also been found that when changing the torsional rigidity distribution of the shaft, designing the center of the gravity of a head into a predetermined configuration stabilizes a behavior of the head and intensifies the operability of the club, and thereby the travel distance can be increased stably.

That is, the present invention intends to provide a golf club which allows an amateur golfer to make an impact timing more easily and can stabilize the behavior of a head thereby intensifying the operability of the club and increasing the travel distance.

To achieve the above-described object, a golf club of the present invention includes a shaft and a head. The shaft is so constructed that the torque of an entire length of the shaft is in a range of 3 to 5° and from viewpoints of a torsional rigidity distribution of the shaft, an integrated value of the torsional rigidity on the grip end of the shaft is 85% or less the integrated value of the torsional rigidity of the entire length of the shaft. The head is so constructed that the distance to the center of gravity is in a range of 40 to 48 mm and the angle of the gravity center is in a range of 22 to 30°.

According to the present invention, a measuring method for a torque of the entire length of the shaft is fixing the shaft at a position 1,040 mm from the front end of the shaft and turning the shaft with a force of 1 foot·pound (0.1383 kgf·m) applied to a position 25 mm from the front end of the shaft in order to measure a twisted angle of the shaft. A measuring method for the torsional rigidity distribution of the shaft is fixing the shaft at positions 200 mm, 400 mm, 600 mm, 800 mm, 1,000 mm from the front end of the shaft and turning the shaft with a force of 1 foot·pound (0.1383 kgf·m) applied to a position 25 mm from the front end of the shaft to measure the twisted angle of the shaft and calculate the torsional rigidity at each measurement position. The integrated value of the torsional rigidity of the entire length of the shaft is a value obtained by integrating the torsional rigidity from 200 mm from the front end of the shaft to 1,000 mm from the front end of the shaft. The integrated value of the torsional rigidity on the grip end side of the shaft is a value obtained by integrating the torsional rigidity from 400 mm from the front end of the shaft to 1,000 mm from the front end of the shaft.

The weight of the shaft may be 65 g or less.

As described above, according to the present invention, the torque of the entire length of the shaft is set to 3 to 5° and in the torsional rigidity distribution of the shaft, the integrated value of the torsional rigidity on the grip end side of the shaft is set to 85% or less the integrated value of the torsional rigidity on the entire length of the shaft. Consequently, in the torsion of the entire shaft, the shaft is twisted a relatively large amount on the grip end side, so that an amateur golfer can make an impact timing more easily and the initial speed of a golf ball can be increased. Although lowering the torsional rigidity of the shaft on the grip end side compared to a conventional club produces a problem in that the operability of the club is degraded, combining this shaft with the head in which the distance to the center of gravity is in a range of 40 to 48 mm and the gravity center angle is in a range of 22 to 30° stabilizes the behavior of the head and intensifies the operability of the club, and thereby the travel distance can be increased.

BRIEF DESCRIPTION OF THE DRAWINGS

FIG. 2 are views for describing a method for measuring a torque of a golf club shaft while

DESCRIPTION OF THE PREFERRED EMBODIMENTS

Figure 1:
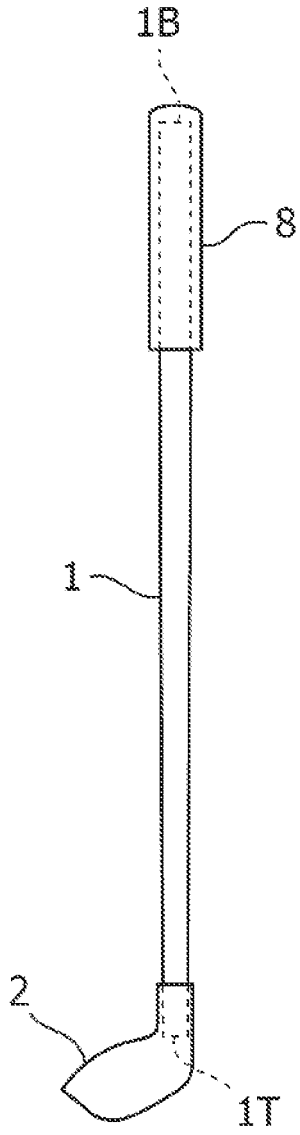
FIG. 1 is a perspective view showing an example of a golf club according to the present invention.

Hereinafter, an embodiment of a golf club according to the present invention will be described with reference to the accompanying drawings. As shown in FIG. 1, the golf club of this embodiment includes a shaft 1, a head 2 and a grip 8. The shaft 1 has a cylindrical shape in which the diameter thereof decreases gradually toward a front end 1T from a grip end 1B.

A head 2 is attached to the front end 1T of the shaft 1 and a grip 8 is attached to the grip end 1B.

A required length of the shaft 1 is in an ordinary length of a wood club shaft and more particularly, is preferred to be 42.5 to 46.0 inches (1,080 to 1,168 mm). A required diameter of the shaft 1 is in an ordinary diameter of the wood club shaft. More specifically, the outside diameter on the grip end is preferred to be 14.0 to 16.0 mm and the outside diameter on the front end side is preferred to be 8.5 to 9.5 mm. The weight of the shaft 1 is preferred to be in a range of 30 to 65 g as the wood club shaft and is more preferred to be 40 to 60 g.

The torsional rigidity distribution of the shaft 1 is so configured that an integrated value of the torsional rigidity on the grip end 1B side of the shaft is much lower than the integrated value of the torsional rigidity of an entire length of the shaft, compared to a conventional case. More specifically, a torque of the entire length of the shaft 1 is set in a range of 3 to 5° and the integrated value of the torsional rigidity on the grip end 1B side of the shaft is set to be 85% or less the integrated value of the torsional rigidity of the entire length of the shaft. When an amateur golfer hits a ball with a golf club having such a configuration, the shaft 1 of the golf club is twisted a large amount on the grip end side. Consequently, the head speed of the golf club is improved and it becomes easier for the golfer to make an impact timing. In the meantime, although the lower limit of the integrated value is not limited to any particular values, it is preferred to be 70% or more, and it is more preferred to be 75% or more.

Figure 2A:
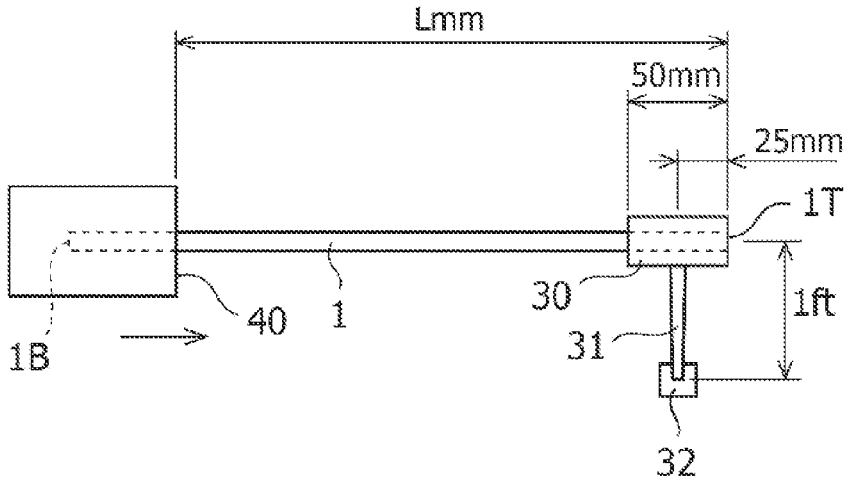
FIG. 2A is a plan view and FIG. 2B is a perspective view.
Figure 2B:
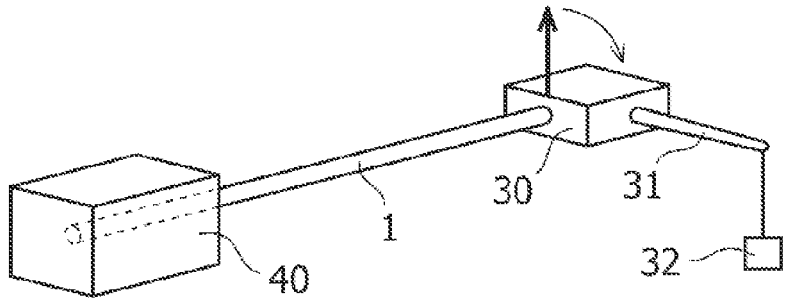

A measuring method for the torque of the shaft 1 will be described with reference to FIGS. 2A and 2B. As for the measuring method for a torque of the entire torque length, a portion after 1040 mm from the front end 1T of the shaft 1 is fixed with a fixing member 40 (that is, a measuring span L from the grip end 1T of the shaft to the fixing member 40 is 1040 mm), and a jig 30 having a length of 50 mm is attached to a portion 50 mm long from the front end 1T. An arm 31 having a length of 1 foot is provided at a central position of the jig 30, namely, at a position 25 mm from the front end 1T of the shaft 1 in a direction perpendicular to the longitudinal direction of the shaft. Then, a weight 32 having a weight of 1 pound is provided at the front end of the arm 31. Thus, the shaft 1 is twisted with a force of 1 foot·pound (0.1383 kgf·m) applied to a position 25 mm from the front end 1T. Then, the twisted angle of the shaft 1 is measured. This measured value is a torque value of the entire shaft length.

Next, a measuring method for the torsional rigidity of the shaft will be described. According to this measuring method also, the shaft is twisted with a force of 1 foot·pound applied to the position 25 mm from the front end 1T of the shaft 1 in the same way as the measuring method for the torque. In this case, the fixing member 40 is fixed under a plurality of measuring spans L, namely, at a plurality of positions selected between the front end 1T side of the shaft and the grip end 1B. Then, the twisted angle is measured when the fixing member is fixed at each position. From the measured twisted angle, a torsional rigidity under each measuring span L is calculated according to a following equation.

$$GI=Mt/\Phi$$

$$\Phi=\theta/L$$

GI: torsional rigidity (kgf·m$^2$/rad)
Mt: load (kgf·m)
θ: twisted angle (rad)
L: measuring span (m)

Figure 3:
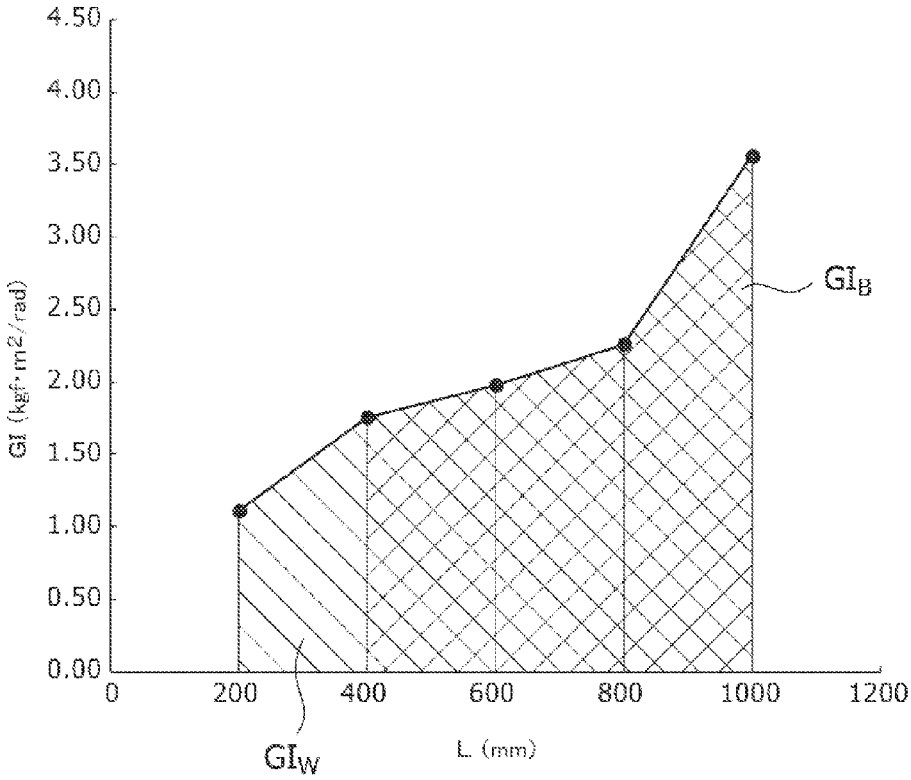
FIG. 3 is a graph for describing the torsional rigidity distribution of a shaft and a sum of the torsional rigidity.

As a result, as shown in FIG. 3, a torsional rigidity of the shaft is obtained at a measuring span L, namely, at a certain length from the front end of the shaft. In measuring the torsional rigidity, the more measuring spans are prepared, the more accurate torsional rigidity distribution can be obtained. However, by preparing the measuring spans L at five positions, 200 mm, 400 mm, 600 mm, 800 mm, and 1,000 mm as shown in FIG. 3, a sufficiently accurate torsional rigidity distribution can be obtained. In this torsional rigidity distribution, an integrated value $GI_w$ of the torsional rigidity of the entire shaft length is a value obtained by integrating the torsional rigidity from 200 mm to 1,000 mm in measuring span L. Furthermore, an integrated value $GI_B$ of the torsional rigidity on the grip end side of the shaft is a value obtained by integrating the torsional rigidity from 400 mm to 1,000 mm in measuring span L. In this torsional rigidity distribution, the torsional rigidities of adjacent measuring spans are collinearly approximate to each other. Thus, integration of the torsional rigidity distribution can be performed by integrating an area of a trapezoid formed between adjacent measuring spans (e.g., between 200 mm and 400 mm in L) as shown in FIG. 3.

In the torsional rigidity distribution of the shaft, an integrated value of the torsional rigidity from 600 mm to 1,000 mm in measuring span L is preferred to be 65% or less the integrated value $GI_w$ of the torsional rigidity of the entire shaft length. Although the lower limit of a ratio of this integrated value is not restricted to any particular value, preferably, it is 50% or more, and more preferably, 55% or more. The torque of the entire shaft length is preferred to be in a range of 3 to 4° if a golfer demands a relatively stiff shaft for an intensified stabilization.

The shaft 1 is produced according to Sheet Winding Method. If explaining in detail, a prepreg sheet of fiber reinforced plastic (FRP) is wound around a mandrel (not shown) and hardened by heat, and the mandrel is pulled out of the hardened product to finish the shaft 1. As the reinforced fiber for the fiber reinforced plastic, it is permissible to use only carbon fiber alone or composite fiber made of carbon fiber and other material fibers, or metallic fiber. Furthermore, as a matrix resin, thermoplastic resin such as epoxy resin may be used.

In the prepreg sheet for use, fibers are oriented substantially in a single direction. When fibers are arranged in parallel to the axis line of the shaft, a straight layer is formed, and when fibers are arranged obliquely, a bias layer is formed. The prepreg sheet for the bias layer is oriented at an angle of 45°, for example, with respect to the shaft axis line of the shaft. Usually, the prepreg sheets for the bias layer, in which the orientation angles of their fibers are in an opposite inclination to each other, are wound into two layers with an amount corresponding to half a circumference shifted to each other.

The prepreg sheet includes a main sheet having the same length as the entire length of the shaft 1 and a reinforcement sheet shorter than the entire length of the shaft. Because the mandrel is tapered such that the diameter thereof increases toward the grip end from the front end, the main sheet is formed in a trapezoidal shape in which the side on the grip end side is longer in order to allow a predetermined circumference of the sheet to be wound equally around the mandrel. The main sheet for the straight layer may be formed into a pentagonal shape by cutting a side of the trapezoid midway in order to reduce the number of windings on the grip end side compared to the front end side. Although the reinforcement sheet may be formed into the trapezoidal shape also, it may be formed into a rectangle or a triangle by forming the side on the grip end side in an oblique shape in order to obtain a predetermined bending rigidity. Usually, the reinforcement sheet is used for the straight layer.

To produce a shaft which attains the torsional rigidity distribution of the present invention independently of the bending rigidity distribution of the shaft, the main sheet for the bias layer is formed into a trapezoidal shape in which the side on the grip end side is shorter than ordinary trapezoids, in order to decrease the number of windings on the grip end side gradually compared to the front end side. When forming such a configuration with the prepreg sheet, the bias layer of the shaft 1 is formed gradually thinner toward the grip end side. Consequently, with a design on the bending rigidity distribution of the shaft maintained as much as possible, the torsional rigidity on the grip end side can be reduced.

Figure 4:
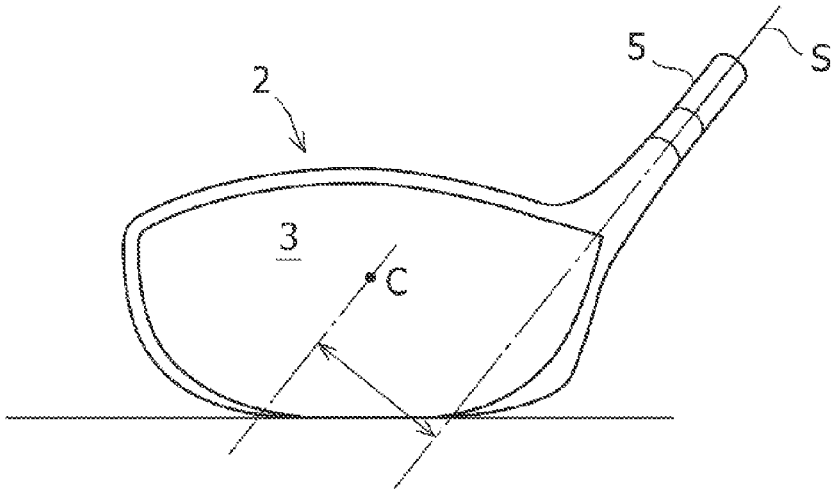
FIG. 4 is a front view for describing a distance between the center of gravity of a golf club head and the axis of its shaft.
Figure 5:
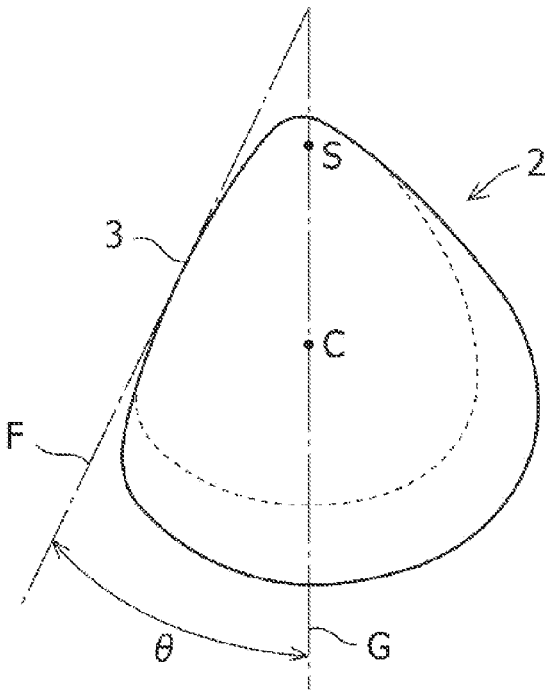
FIG. 5 is a plan view of a golf club head for describing an angle of the center of gravity.

In the head 2 for use, the distance to the center of gravity is in a range of 40 to 48 mm. As shown in FIG. 4, the distance to the center of gravity mentioned here refers to a distance from a shaft axis line S which is a central line of a hosel 5 of the head 2 up to the gravity center C of the head. More preferably, the distance to the center of gravity is in a range of 42 to 46 mm.

In the head 2 for use, the gravity center angle is in a range of 22 to 30°. As shown in FIG. 4, the gravity center mentioned here refers to an angle formed between a line passing through the shaft axis line S and the head gravity center C, and a tangent line F on a face surface 3 of the head. More preferably, the gravity center angle is in a range of 23 to 26°.

Combination of the head 2 having the distance to the gravity center and the gravity center angle in the aforementioned ranges with the shaft 1 having the above-described bending rigidity distribution enables an amateur golfer to make an impact timing more easily. As a result, the initial speed of the golf ball is increased, and furthermore, the head behavior is stabilized to intensify the operability of the club and thereby the travel distance is increased.

EXAMPLE

Figure 6:
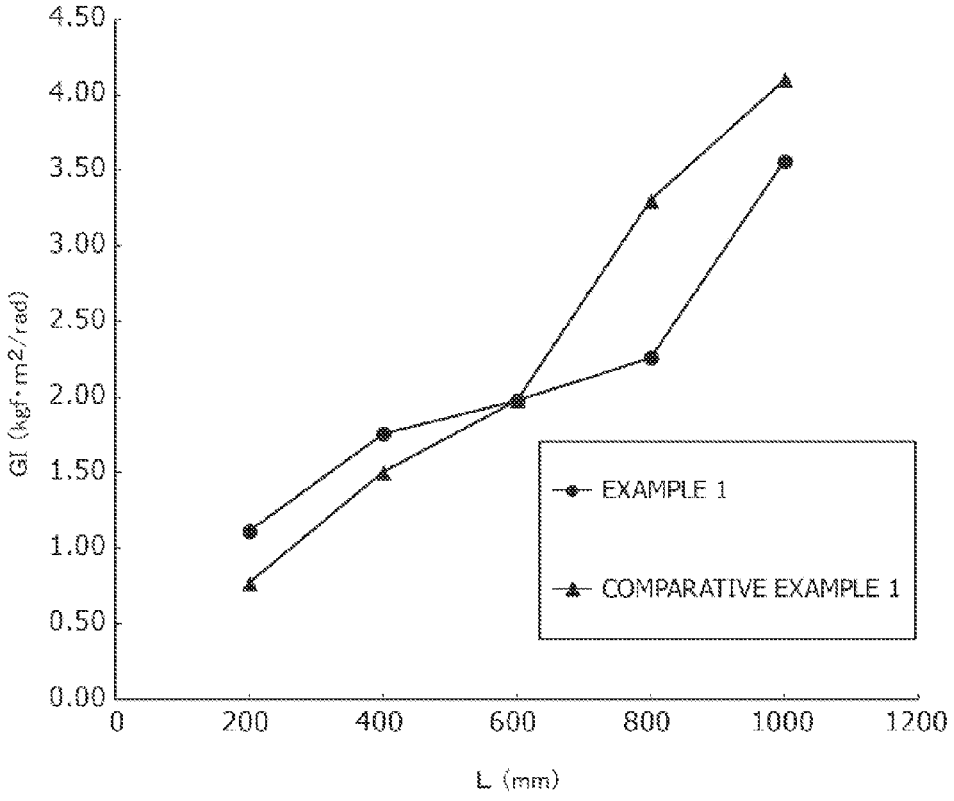
FIG. 6 is a graph showing the torsional rigidity distributions of the shafts of this embodiment and a comparative example.

Shafts 1 to 4 of the first to fifth examples and comparative examples 1 to 4 as shown in Table 1 having a torsional rigidity distribution and a torque of the entire shaft length indicated in Table 1 were produced and tested by hitting a ball. Table 2 shows a ball travel distance at that time and an evaluation by a testing golfer who hit a ball with the golf club. Table 2 indicates an integrated value ($GI_W$) of the torsional rigidity of the entire shaft length, calculated from the torsional rigidity distribution in Table 1, an integrated value ($GI_B$) of the torsional rigidity on the grip end side and a ratio therebetween ($GI_B/GI_W$). FIG. 6 indicates the torsional rigidity distribution of the shaft according to the first example and the comparative example 1. FIG. 6 indicates that the shaft 1 of the first example had a distribution in which the torsional rigidity on the grip end side is lower compared to the shaft according to the comparative example 1. In the meantime, all the shafts were combined with identical heads. The distance to the center of gravity is 45 mm and the gravity center angle is 25°.

TABLE 1

| | Torsional rigidity [kgf · m²/rad] | | | | | Torque of entire length [°] |
|---|---|---|---|---|---|---|
| | L = 200 mm | L = 400 mm | L = 600 mm | L = 800 mm | L = 1000 mm | |
| Example 1 | 1.11 | 1.76 | 1.98 | 2.26 | 3.56 | 4.0 |
| Example 2 | 1.35 | 2.00 | 2.48 | 3.13 | 4.00 | 3.0 |
| Example 3 | 0.95 | 1.31 | 1.51 | 1.68 | 2.67 | 4.8 |
| Example 4 | 1.43 | 2.27 | 2.56 | 2.92 | 4.59 | 3.1 |
| Example 5 | 0.84 | 1.10 | 1.53 | 1.80 | 2.60 | 4.8 |
| Comparative example 1 | 0.77 | 1.50 | 1.98 | 3.30 | 4.10 | 3.5 |
| Comparative example 2 | 1.74 | 2.58 | 2.81 | 3.77 | 4.82 | 2.8 |
| Comparative example 3 | 0.77 | 1.28 | 1.49 | 1.65 | 2.50 | 5.4 |
| Comparative example 4 | 0.53 | 0.89 | 1.21 | 1.87 | 3.28 | 5.5 |

TABLE 2

| | Torsional rigidity | | | | |
|---|---|---|---|---|---|
| | Integrated value of entire length ($GI_W$) | Integrated value on grip end side ($GI_B$) | Ratio ($GI_B/GI_W$) [%] | Travel distance | Evaluation by testing golfer |
| Example 1 | 1.67 | 1.38 | 82.6 | 5 | 5 |
| Example 2 | 2.06 | 1.72 | 83.5 | 4 | 4 |
| Example 3 | 1.26 | 1.04 | 81.9 | 4 | 4 |
| Example 4 | 2.15 | 1.78 | 82.8 | 4 | 5 |
| Example 5 | 1.23 | 1.04 | 84.6 | 5 | 4 |
| Comparative example 1 | 1.84 | 1.62 | 87.6 | 3 | 4 |
| Comparative example 2 | 2.49 | 2.06 | 82.7 | 1 | 2 |
| Comparative example 3 | 1.21 | 1.01 | 82.8 | 4 | 3 |
| Comparative example 4 | 1.18 | 1.03 | 88.0 | 2 | 2 |

The travel distances in the table were evaluated according to five grades in which 5 is the highest and 1 is the lowest. The evaluation by the testing golfer concerns easiness of making an impact timing, stability of the head during a swing and the operability of the club and was implemented according to the five grades in which 5 is the highest and 1 is the lowest.

As indicated in Table 2, the clubs of the first to fifth examples were evaluated as 4 or higher in the travel distance and sensory test. On the other hand, in the comparative example 1 which ensured a high torsional rigidity on the grip end side, the travel distance was not expanded and the evaluation was 3. Although the result of the sensory test was as good as 4, the testing golfer evaluated that the impact was not stabilized easily. In the comparative example 2 in which the torsional rigidity on the grip end side was low and its overall torque was too low, the travel distance was not expanded and this was evaluated as the lowest mark of 1. In the sensory test also, the testing golfer evaluated severely that the entire shaft felt hard so that he could not make an impact timing easily. In the comparative example 3, in which the entire torque was too high while the torsional rigidity on the grip end side was low, the travel distance was improved but in the sensory test, according to an evaluation by the testing golfer, the entire behavior of the head felt large so that he felt it difficult to make an impact timing. In the comparative example 4 in which the entire torque was too high while the torsional rigidity on the grip end side was high, the travel distance was not expanded and, in the sensory test, it was evaluated that the behavior of the front end portion felt strong, making the testing golfer feel that the behavior of the club was dysfunctional and a swing was difficult.

Likewise, a club in which the shaft used in the first example and the comparative example 4 was combined with the head having the distance to the gravity center and the gravity center angle indicated in Table 3 was tested by hitting a ball. Table 3 shows its result. The "catch" mentioned in the table means a testing golfer's evaluation concerning how effectively the head of the club can catch a ball. Like above, the catch was evaluated according to the five grades in which 5 is the highest and 1 is the lowest.

TABLE 3

| | Distance to center of gravity [mm] | Gravity center angle [°] | Shaft | Travel distance | Catch | Evaluation by testing golfer |
|---|---|---|---|---|---|---|
| Example A | 45 | 25 | Same as first embodiment | 5 | 4 | 5 |
| Example B | 41 | 25 | Same as first embodiment | 4 | 3 | 4 |
| Example C | 46 | 23 | Same as first embodiment | 5 | 4 | 4 |
| Example D | 45 | 28 | Same as first embodiment | 4 | 5 | 3 |
| Comparative example A | 38 | 25 | Same as first embodiment | 2 | 1 | 3 |
| Comparative example B | 44 | 32 | Same as first embodiment | 3 | 4 | 2 |
| Comparative example C | 44 | 32 | Same as comparative example 4 | 2 | 4 | 1 |

As indicated in Table 3, the clubs of the examples A to D consistently had high evaluations in terms of the travel distance and sensory tests. On the other hand, in the comparative example A in which the shaft of the first example was combined with a head having a short distance to the center of gravity, the travel distance was not increased and the catch was poor, so that the ball was inclined to fly rightward. Furthermore, in the comparative example B in which the shaft of the first example was combined with a head having a large gravity center angle, the travel distance was not increased, although the catch was acceptable, and it was evaluated that the operability of the club was poor and the swing was heavy.

What is claimed is:

1. A golf club comprising a shaft and a head, wherein the shaft has a torque of an entire length thereof of 3 to 5°, wherein in a torsional rigidity distribution of the shaft, an integrated value of the torsional rigidity on the grip end of the shaft is at most 85% of the integrated value of the torsional rigidity of the entire length of the shaft, wherein a measuring method for a torque of the entire length of the shaft is fixing the shaft at a position 1,040 mm from the front end of the shaft and turning the shaft with a force of 1 foot·pound (0.1383 kgf·m) applied to a position 25 mm from the front end of the shaft in order to measure a twisted angle of the shaft, wherein a measuring method for the torsional rigidity distribution of the shaft is fixing the shaft at positions 200 mm, 400 mm, 600 mm, 800 mm, and 1,000 mm from the front end of the shaft and turning the shaft with a force of 1 foot·pound (0.1383 kgf·m) applied to a position 25 mm from the front end of the shaft in order to measure the twisted angle of the shaft and calculate the torsional rigidity at each measurement position, wherein the integrated value of the torsional rigidity of the entire length of the shaft is a value obtained by integrating the torsional rigidity from 200 mm from the front end of the shaft to 1,000 mm from the front end of the shaft, wherein the integrated value of the torsional rigidity on the grip end side of the shaft is a value obtained by integrating the torsional rigidity from 400 mm from the front end of the shaft to 1,000 mm from the front end of the shaft, wherein the head has a distance to the center of gravity of 40 to 48 mm and has a gravity center angle of 22 to 30°.

2. The golf club according to claim 1, wherein the weight of the shaft is at most 65 g.

* * * * *